US011747051B2

(12) United States Patent
Kuramitsu

(10) Patent No.: US 11,747,051 B2
(45) Date of Patent: Sep. 5, 2023

(54) COOLING DEVICE, ELECTRONIC APPARATUS, AND COOLING METHOD

(71) Applicant: FUJITSU LIMITED, Kawasaki (JP)

(72) Inventor: Kouichi Kuramitsu, Setagaya (JP)

(73) Assignee: FUJITSU LIMITED, Kawasaki (JP)

( * ) Notice: Subject to any disclaimer, the term of this patent is extended or adjusted under 35 U.S.C. 154(b) by 184 days.

(21) Appl. No.: 17/363,296

(22) Filed: Jun. 30, 2021

(65) Prior Publication Data

US 2022/0074626 A1 Mar. 10, 2022

(30) Foreign Application Priority Data

Sep. 9, 2020 (JP) ..... 2020-151428

(51) Int. Cl.
*F25B 5/02* (2006.01)
*F25B 41/20* (2021.01)

(52) U.S. Cl.
CPC ..... *F25B 5/02* (2013.01); *F25B 41/20* (2021.01); *F25B 2400/161* (2013.01); *F25B 2400/23* (2013.01)

(58) Field of Classification Search
CPC ..... F25B 5/02; F25B 41/20; F25B 2400/16; F25B 2400/161; F25B 2400/23; F25B 2313/001
See application file for complete search history.

(56) References Cited

U.S. PATENT DOCUMENTS 11,320,170 B2 * 5/2022 Kozasa ..... F25B 5/04
11,365,906 B2 * 6/2022 Eadelson ..... F25B 41/20
11,473,814 B2 * 10/2022 Zha ..... F25B 31/00
2016/0366793 A1 * 12/2016 Kikuchi ..... F28F 9/0204
2018/0249590 A1 8/2018 Hayashi
2019/0086130 A1 * 3/2019 Hellmann ..... F25B 5/02
2019/0368786 A1 * 12/2019 Newel ..... F25B 21/00
2020/0166246 A1 * 5/2020 Eadelson ..... F25B 41/22
2020/0363102 A1 * 11/2020 Zha ..... F25B 40/02
(Continued)

FOREIGN PATENT DOCUMENTS

DE 102017110560 A1 * 11/2018 ..... F25B 1/10
FR 3111416 A1 * 12/2021
(Continued)

OTHER PUBLICATIONS

English translation of Sugiyama et al. (JP 2003083644 A). (Year: 2003).*

*Primary Examiner* — Miguel A Diaz
(74) *Attorney, Agent, or Firm* — WHDA, LLP

(57) ABSTRACT

A cooling device includes a plurality of evaporators thermally coupled to a plurality of heat generating devices, respectively, a condenser coupled to the plurality of evaporators through a gas-phase pipe, a first tank coupled to the condenser through a liquid-phase pipe and configured to store a refrigerant therein, a second tank disposed at a position higher than the plurality of evaporators and configured to store the refrigerant therein, a plurality of distribution pipes each through which a corresponding evaporator of the plurality of evaporators is coupled to the second tank, a pump coupled to the first tank and the second tank through coupling pipes, respectively, and a bypass pipe through which the second tank is coupled to one of the first tank and the liquid-phase pipe.

13 Claims, 6 Drawing Sheets

(56) References Cited

U.S. PATENT DOCUMENTS

| | | | | |
|---|---|---|---|---|
| 2020/0363109 | A1* | 11/2020 | Sun | F25B 41/20 |
| 2022/0268501 | A1* | 8/2022 | Subrahmanya | F25B 39/028 |
| 2022/0316764 | A1* | 10/2022 | Eadelson | F25B 5/02 |

FOREIGN PATENT DOCUMENTS

| | | | | | |
|---|---|---|---|---|---|
| JP | 1-160894 | U | | 11/1989 | |
| JP | 2003083644 | A | * | 3/2003 | F25B 13/00 |
| JP | 2005-228216 | A | | 8/2005 | |
| JP | 2008-509542 | A | | 3/2008 | |
| JP | 2013003636 | A | * | 1/2013 | |
| JP | 2018-142184 | A | | 9/2018 | |
| JP | 2020119976 | A | * | 8/2020 | H05K 7/20327 |
| WO | 2006/004869 | A2 | | 1/2006 | |
| WO | WO-2014192252 | A1 | * | 12/2014 | F25B 23/006 |

* cited by examiner

COOLING DEVICE, ELECTRONIC APPARATUS, AND COOLING METHOD

CROSS-REFERENCE TO RELATED APPLICATION

This application is based upon and claims the benefit of priority of the prior Japanese Patent Application No. 2020-151428, filed on Sep. 9, 2020, the entire contents of which are incorporated herein by reference.

FIELD

The embodiment discussed herein is related to a cooling device, an electronic apparatus, and a cooling method.

BACKGROUND

There are the following cooling devices each for cooling multiple devices.

A first type of cooling device includes multiple modules respectively attached to semiconductor devices, an outlet header and an intake header each coupled to the multiple modules, and a condenser coupled to the multiple modules through the outlet header and the intake header. A pump is provided between the multiple modules and a heat exchanger. When the pump is operated, a refrigerant circulates between the multiple modules and the heat exchanger.

A second type of cooling device includes multiple heat exchangers respectively coupled to devices, and an intake manifold and an exhaust manifold each coupled to the multiple heat exchangers. The multiple heat exchangers are supplied with a refrigerant through the intake manifold, and the refrigerant having exchanged heat with the devices in the multiple heat exchangers is discharged through the exhaust manifold.

A third type of cooling device includes multiple water cooling units respectively attached to semiconductor devices, and a cooling water circulating device coupled to the multiple water cooling units. The multiple water cooling units and the cooling water circulating device are coupled to each other through a return pipe and a supply pipe, and a bypass path is provided between the return pipe and the supply pipe.

A fourth type of cooling device includes multiple evaporators respectively provided to electronic apparatuses, a water supply pipe which includes multiple branch pipes coupled to the multiple evaporators and which supplies a coolant liquid to the evaporators, and a water discharge pipe which includes multiple branch pipes coupled to the multiple evaporators and to which the coolant liquid having passed through the evaporators is discharged. The water supply pipe and the water discharge pipe are coupled to each other through a circulation pipe, and the circulation pipe is provided with a pump and a heat exchanger. A bypass path is coupled to an upper end portion of the water supply pipe. The bypass path is coupled to the water discharge pipe or the circulation pipe while bypassing the multiple evaporators.

Japanese Laid-open Patent Publication Nos. 2005-228216 and 2018-142184, Japanese National Publication of International Patent Application No. 2008-509542, and Japanese Unexamined Utility Model Registration Application Publication No. 1-160894 are disclosed as related art.

SUMMARY

According to an aspect of the embodiments, a cooling device includes a plurality of evaporators thermally coupled to a plurality of heat generating devices, respectively, a condenser coupled to the plurality of evaporators through a gas-phase pipe, a first tank coupled to the condenser through a liquid-phase pipe and configured to store a refrigerant therein, a second tank disposed at a position higher than the plurality of evaporators and configured to store the refrigerant therein, a plurality of distribution pipes each through which a corresponding evaporator of the plurality of evaporators is coupled to the second tank, a pump coupled to the first tank and the second tank through coupling pipes, respectively, and a bypass pipe through which the second tank is coupled to one of the first tank and the liquid-phase pipe, wherein the second tank includes a first joint port to be joined to the bypass pipe, second joint ports to be joined to the respective distribution pipes, and a third joint port to be the coupling pipe, the first joint port being formed at a position higher than the second joint ports and the third joint port, and wherein an inner diameter of the bypass pipe is larger than an inner diameter of each of the distribution pipes.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

In a case where a cooling device for cooling multiple devices includes a pump for sending a refrigerant, there is a demand that an electronic apparatus including the cooling device be downsized and simplified in structure.

Embodiment

Description will be given of an electronic apparatus 10 according to an embodiment of a technology capable of achieving downsizing and structure simplification of an electronic apparatus including a cooling device.

Figure 1:
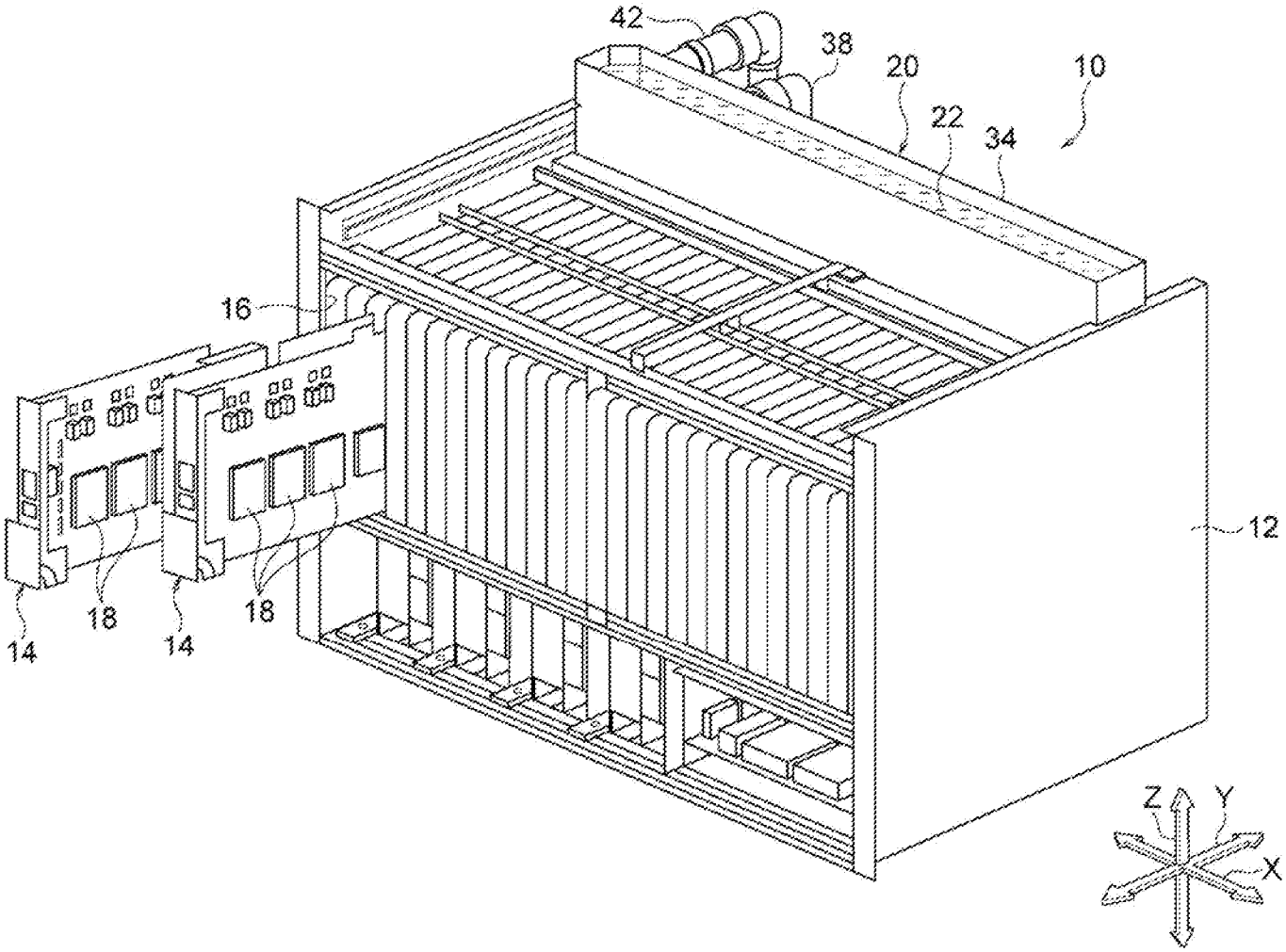
FIG. 1 is a perspective view of an electronic apparatus according to an embodiment of the technology disclosed herein.

FIG. 1 is a perspective view of the electronic apparatus 10 according to the embodiment of the technology disclosed herein. The electronic apparatus 10 illustrated in FIG. 1 is, for example, a network apparatus. An arrow X direction indicates the right-left direction of the electronic apparatus 10, an arrow Y direction indicates the front-rear direction of the electronic apparatus 10, and an arrow Z direction indicates the vertical direction of the electronic apparatus 10.

The electronic apparatus 10 includes a housing 12 and multiple electronic units 14. The housing 12 is formed in a box shape. The housing 12 has an opening 16 that is opened in the front-rear direction of the electronic apparatus 10. In the housing 12, the multiple electronic units 14 are housed side by side in the right-left direction of the electronic apparatus 10. The multiple electronic units 14 are inserted into and removed from the housing 12 through the opening 16. Each of the multiple electronic units 14 may be referred to as a plug-in card.

Each of the electronic units 14 has a substantially flat plate shape. Each of the electronic units 14 is disposed in the housing 12 in the state where the thickness direction of the electronic unit 14 is aligned with the right-left direction of the electronic apparatus 10. Devices 18 are mounted on each of the electronic units 14. The devices 18 are, for example, heating generating elements such as a central processing unit (CPU). The device 18 is an example of a "heat generating device". The electronic apparatus 10 includes a cooling device 20 of an ebullient cooling type for cooling the multiple devices 18.

Figure 2:
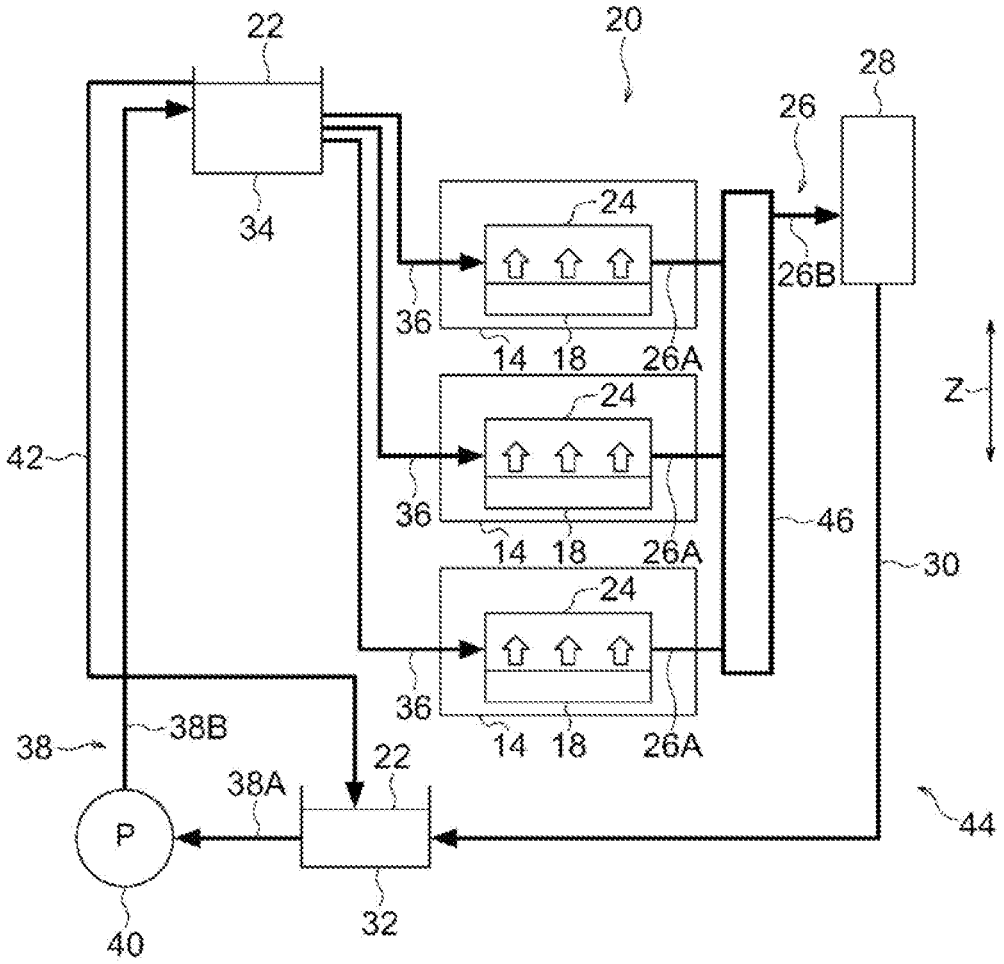
FIG. 2 is a diagram schematically illustrating a cooling device according to an embodiment of the technology disclosed herein.

FIG. 2 is a diagram schematically illustrating the cooling device 20 according to the embodiment of the technology disclosed herein. The cooling device 20 includes a refrigerant 22, multiple evaporators 24, a gas-phase pipe 26, a condenser 28, a liquid-phase pipe 30, a first tank 32, a second tank 34, multiple distribution pipes 36, a coupling pipe 38, a pump 40, and a bypass pipe 42.

The multiple evaporators 24, the gas-phase pipe 26, the condenser 28, the liquid-phase pipe 30, the first tank 32, the second tank 34, the multiple distribution pipes 36, the coupling pipe 38, the pump 40, and the bypass pipe 42 form a circulation circuit 44. This circulation circuit 44 is filled with the refrigerant 22.

The refrigerant 22 is, for example, water, but may be any other than water. An insufficient amount of the refrigerant 22 leads to dryout in which the evaporators 24 to be described later run short of the refrigerant 22, while an excessive amount of the refrigerant 22 fails to boil the refrigerant 22 in the evaporators 24 and to produce a cooling effect by latent heat. The circulation circuit 44 is filled with an appropriate amount of the refrigerant 22 so that the refrigerant 22 may continuously produce the cooling effect by the latent heat while inhibiting the dryout in the evaporators 24.

Each of the multiple evaporators 24 is thermally coupled to the device 18. Each of the evaporators 24 may be directly coupled to the device 18 or may be indirectly coupled to the device 18 via, for example, a heat transfer member such as a heat spreader. For example, each of the evaporators 24 may be coupled to the device 18 to be cooled in any coupling structure as long as the evaporator 24 is coupled to the device 18 in a thermally conductive manner.

Each of the evaporators 24 is formed of a hollow body having an internal space. Each of the evaporators 24 has a structure that causes the liquid-phase refrigerant 22 sent to the evaporator 24 to exchange heat with the device 18 and thereby changes the refrigerant 22 into a gas phase by evaporation. Each of the evaporators 24 may be referred to as a cold plate.

The gas-phase pipe 26 includes multiple branch pipes 26A and a trunk pipe 26B. The multiple branch pipes 26A are respectively coupled to outlets of the evaporators 24. The multiple branch pipes 26A are coupled to the trunk pipe 26B via a joint member 46 to be described later, and the trunk pipe 26B is coupled to an inlet of the condenser 28.

The condenser 28 is coupled to the multiple evaporators 24 through the gas-phase pipe 26. The condenser 28 is supplied with a cooling fluid from a cooling mechanism (not illustrated). The condenser 28 has a structure that causes the gas-phase refrigerant 22 to exchange heat with the cooling fluid and thereby changes the refrigerant 22 to a liquid phase by condensation. The condenser 28 may be of either a water-cooling type using a liquid as the cooling fluid or an air-cooling type using a gas as the cooling fluid. In an example, the condenser 28 is disposed at a position higher than the first tank 32. In an example, the condenser 28 is disposed at a position horizontally shifted from the second tank 34.

The first tank 32 is coupled to the condenser 28 through the liquid-phase pipe 30. The first tank 32 stores therein the refrigerant 22. In an example, the first tank 32 is disposed at a position lower than the multiple evaporators 24 and the second tank 34. In an example, the first tank 32 is disposed at a lower portion in the electronic apparatus 10 (see FIG. 1).

In an example, the second tank 34 is disposed at a position higher than the multiple evaporators 24. In an example, the second tank 34 is disposed at an upper portion in the electronic apparatus 10 (see FIG. 1). The second tank 34 stores therein the refrigerant 22.

The pump 40 is coupled between the first tank 32 and the second tank 34 via the coupling pipe 38. For example, the coupling pipe 38 includes a first coupling pipe 38A that couples the first tank 32 and the pump 40, and a second coupling pipe 38B that couples the pump 40 and the second tank 34. The pump 40 operates to send the refrigerant 22 stored in the first tank 32 to the second tank 34.

The pump 40 is preferably disposed at a position where the pump 40 is easily replaceable. The pump 40 may be disposed at any position in the electronic apparatus 10. In the present embodiment, for example, the pump 40 is disposed at a position lower than the multiple evaporators 24 and the second tank 34. In an example, the pump 40 is disposed at a lower portion in the electronic apparatus 10. The pump 40 may be disposed inside or outside the housing 12 (see FIG. 1).

The multiple distribution pipes 36 couple the second tank 34 to the respective inlets of the multiple evaporators 24. The bypass pipe 42 couples the second tank 34 and the first tank 32 together while bypassing the multiple evaporators 24 and the condenser 28.

Figure 3:
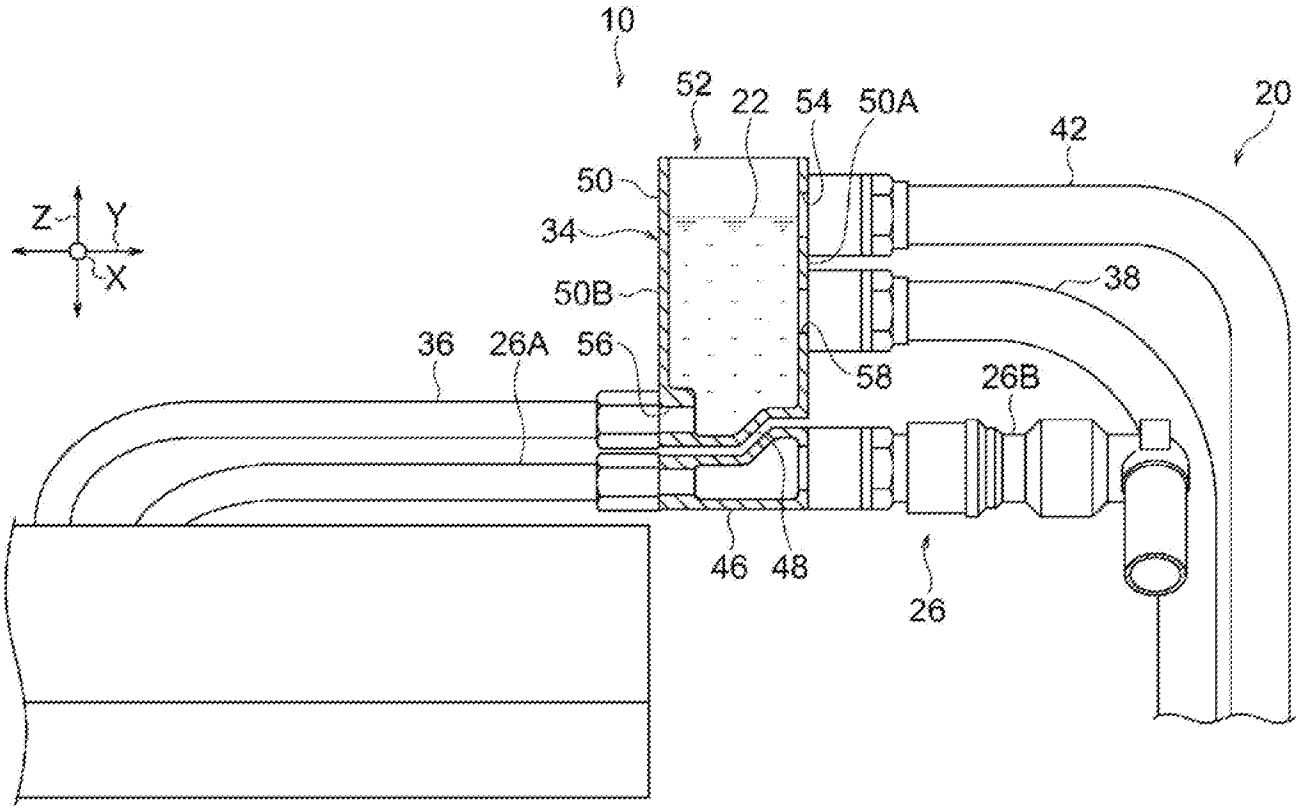
FIG. 3 is a side view of a second tank and a peripheral portion thereof illustrated in FIG. 2, partially including a cross sectional view.

FIG. 3 is a side view of the second tank 34 and a peripheral portion thereof illustrated in FIG. 2, partially including a cross sectional view. The second tank 34 couples the multiple distribution pipes 36, the coupling pipe 38, and the bypass pipe 42 to each other. The joint member 46 is disposed below the second tank 34. The second tank 34 and the joint member 46 may be formed integrally or separately. The joint member 46 joins together the multiple branch pipes 26A and the trunk pipe 26B forming the gas-phase pipe 26.

FIG. 3 illustrates one of the multiple distribution pipes 36. The multiple distribution pipes 36 are arranged side by side in the arrow X direction. Similarly, FIG. 3 illustrates one of the multiple branch pipes 26A forming part of the gas-phase pipe 26. The multiple branch pipes 26A are arranged side by side in the arrow X direction. In an example, the inner diameters of the multiple distribution pipes 36 are the same. Similarly, in an example, the inner diameters of the multiple branch pipes 26A are the same.

The second tank 34 is formed in a recessed shape and includes a bottom wall portion 48 and a peripheral wall portion 50 formed around the bottom wall portion 48. An upper portion 52 of the second tank 34 is partially or entirely opened to the upper side. The second tank 34 includes a first joint port 54 to be joined to the bypass pipe 42, second joint ports 56 to be joined to the respective distribution pipes 36, and a third joint port 58 to be joined to the coupling pipe 38.

The first joint port 54, the second joint ports 56, and the third joint port 58 are all formed in the peripheral wall portion 50. The peripheral wall portion 50 includes a first vertical wall portion 50A and a second vertical wall portion 50B that face each other in the horizontal direction. The first joint port 54 and the third joint port 58 are formed in the first vertical wall portion 50A, whereas the second joint ports 56 are formed in the second vertical wall portion 50B. The first joint port 54, the second joint ports 56, and the third joint port 58 may each have any shape such as a circular, square, or rectangular shape, for example.

The first joint port 54 is formed at a position higher than the second joint ports 56 and the third joint port 58. In an example, the second joint ports 56 are formed at positions lower than the third joint port 58. In an example, the inner diameters of the multiple second joint ports 56 are the same.

The inner diameter of the bypass pipe 42 is larger than the inner diameter of each of the distribution pipes 36. The inner diameter of the bypass pipe 42 is set such that the pressure loss of the bypass pipe 42 is sufficiently smaller than the total pressure loss of the multiple distribution pipes 36. With the inner diameter of the bypass pipe 42 set in this manner, the pressure of the pump 40 is released to the bypass pipe 42 and therefore is inhibited from acting on the multiple distribution pipes 36 when the liquid level of the refrigerant 22 in the second tank 34 is higher than the position of the lower end of the first joint port 54.

Since the pressure of the pump 40 is inhibited from acting on the multiple distribution pipes 36, the refrigerant 22 is supplied by using the force of gravity from the second tank 34 to the multiple evaporators 24 through the multiple distribution pipes 36 (see FIG. 2). In order to effectively inhibit the pressure of the pump 40 from being applied to the multiple distribution pipes 36, for example, the upper portion 52 of the second tank 34 is partially or entirely opened. An upper portion of the first tank 32 may be also partially or entirely opened.

The inner diameters of the distribution pipes 36 are set, in accordance with characteristics such as a power consumption by and the amount of the refrigerant 22 consumed by evaporation in each of the devices 18 and the viscosity coefficient of the refrigerant 22, such that each distribution pipe 36 has a pressure loss allowing the refrigerant 22 to be supplied to the corresponding device 18.

The inner diameters of the multiple distribution pipes 36 are the same in an example, but the inner diameters of the multiple distribution pipes 36 may be different from each other. When the inner diameters of the multiple distribution pipes 36 are different from each other, the inner diameter of the bypass pipe 42 is larger than the inner diameters of all the multiple distribution pipes 36.

The inner diameter of the bypass pipe 42 is larger than the inner diameter of each of the distribution pipes 36, and accordingly the opening area of the first joint port 54 is larger than the opening area of each of the second joint ports 56.

The liquid level of the refrigerant 22 in the second tank 34 is set at a position higher than the lower end of the first joint port 54 so that the refrigerant 22 stored in the second tank 34 flows into the bypass pipe 42. The liquid level of the refrigerant 22 in the second tank 34 is, for example, a liquid level under the condition where the cooling device 20 is not operated, for example, where the multiple evaporators 24 are at normal temperature.

The maximum amount of the refrigerant 22 stored in the second tank 34 is determined by the height of the first joint port 54 that is a joint port where the bypass pipe 42 is joined to the second tank 34. The maximum amount of the refrigerant 22 stored in the second tank 34 is set to an amount exceeding the maximum consumption amount of the refrigerant 22 that may be consumed by the multiple devices 18 in consideration of the maximum power of the devices 18.

Next, a cooling method according to the embodiment of the technology disclosed herein will be described.

The cooling method according to the present embodiment is a method of cooling each of the multiple devices 18 illustrated in FIG. 1 in accordance with the amount of heat generated by the device 18, and is performed by using the cooling device 20 described above. This cooling method includes an evaporation step, a condensation step, a first storage step, a second storage step, and a distribution step.

In the evaporation step, the multiple evaporators 24 thermally coupled to the multiple devices 18 evaporate the refrigerant 22 by using heat of the multiple devices 18. Thus, the devices 18 are each cooled by using latent heat generated when the refrigerant 22 is evaporated. The refrigerant 22 changed to the gas phase by evaporation in the multiple evaporators 24 is sent to the condenser 28 through the gas-phase pipe 26.

In the condensation step, the gas-phase refrigerant 22 exchanges heat with the cooling fluid in the condenser 28, and the refrigerant 22 is changed to a liquid phase by condensation. The refrigerant 22 changed to the liquid phase by condensation in the condenser 28 is sent to the first tank 32 through the liquid-phase pipe 30.

In the first storage step, the refrigerant 22 sent to the first tank 32 through the liquid-phase pipe 30 is stored in the first tank 32. The refrigerant 22 stored in the first tank 32 is sent by the pump 40 to the second tank 34 disposed at the position higher than the multiple evaporators 24. In this step, the rotation speed of the pump 40 is controlled such that the liquid level of the refrigerant 22 in the second tank 34 is maintained at a position higher than the lower end of the first joint port 54.

In the second storage step, the refrigerant 22 sent to the second tank 34 by the pump 40 is stored in the second tank 34.

In the distribution step, the refrigerant 22 stored in the second tank 34 is distributed to the multiple evaporators 24 in accordance with the respective amounts of heat generated by the multiple devices 18.

The second tank 34 and the first tank 32 are coupled to each other by the bypass pipe 42. The first joint port 54 of the second tank 34 to be joined to the bypass pipe 42 is formed at the position higher than the second joint ports 56 of the second tank 34 to be joined to the respective distribution pipes 36 and the third joint port 58 of the second tank 34 to be joined to the coupling pipe 38. The inner diameter of the bypass pipe 42 is larger than the inner diameter of each of the distribution pipes 36.

Therefore, when the refrigerant 22 is distributed from the second tank 34 to the multiple evaporators 24 through the multiple distribution pipes 36, part of the refrigerant 22 stored in the second tank 34 is returned to the first tank 32 through the bypass pipe 42. Thus, the pressure of the pump 40 is released to the bypass pipe 42 and therefore is inhibited from acting on the multiple distribution pipes 36. The partially or entirely opened upper portion 52 of the second tank 34 more effectively inhibits the pressure of the pump 40 from acting on the multiple distribution pipes 36. The same effects are also obtained even when the upper portion of the first tank 32 is partially or entirely opened.

In this state, as similarly to a pump-less ebullient cooling device, the refrigerant 22 flows into each of the multiple evaporators 24 from the second tank 34 due to its own weight in accordance with the amount of heat generated by the corresponding one of the multiple devices 18. For example, each of the multiple evaporators 24 is supplied with the refrigerant 22 in an amount equal to an amount of the refrigerant 22 reduced by evaporation. Thus, the multiple devices 18 different in power consumption are continuously and appropriately cooled by the multiple evaporators 24.

Next, operations and effects of the present embodiment will be described.

First, a first comparative example and a second comparative example will be described in order to clarify the operations and effects of the present embodiment.

Figure 5:
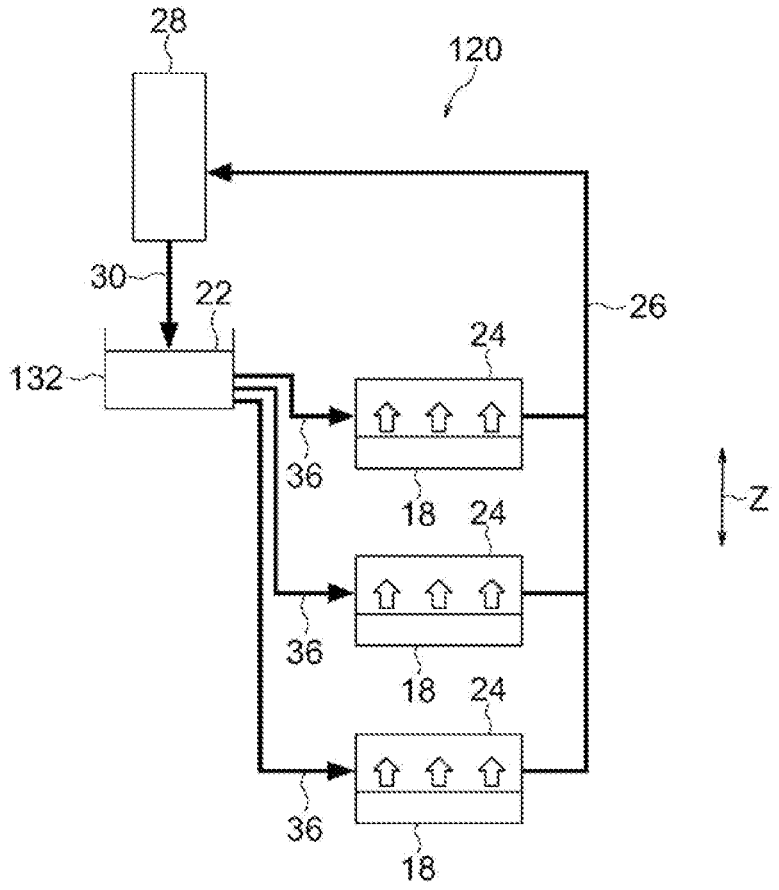
FIG. 5 is a diagram schematically illustrating a cooling device according to a first comparative example.

FIG. 5 is a diagram schematically illustrating a cooling device 120 according to the first comparative example. The cooling device 120 according to the first comparative example is a pump-less ebullient cooling device. In the cooling device 120 according to the first comparative example, a tank 132 is used instead of the first tank 32 and the second tank 34 (see FIG. 2).

Multiple evaporators 24 are coupled to the tank 132 through multiple distribution pipes 36, and a condenser 28 is coupled to the multiple evaporators 24 through a gas-phase pipe 26. The condenser 28 and the tank 132 are coupled to each other through a liquid-phase pipe 30. The tank 132 is disposed at a position higher than the multiple evaporators 24, and the condenser 28 is disposed at a position further higher than the tank 132.

In the cooling device 120 according to the first comparative example, a refrigerant 22 changed to the liquid phase by condensation in the condenser 28 is sent to the tank 132 through the liquid-phase pipe 30 and stored in the tank 132. The refrigerant 22 flows into each of the multiple evaporators 24 from the tank 132 due to its own weight in accordance with the amount of heat generated by the corresponding one of the multiple devices 18. For example, each of the multiple evaporators 24 is supplied with the refrigerant 22 in an amount equal to an amount of the refrigerant 22 reduced by evaporation. Thus, the multiple devices 18 different in power consumption are continuously and appropriately cooled by the multiple evaporators 24.

Since the cooling device 120 according to the first comparative example is pump-less, the cooling device 120 may be simplified in structure owing to the absence of the pump, and will not request replacement of a pump, which is a life-limited component.

However, in the cooling device 120 according to the first comparative example, the tank 132 has to be disposed at the position higher than the multiple evaporators 24, and the condenser 28 has to be disposed at the position further higher than the tank 132. Therefore, since the condenser 28 and the tank 132 have to be disposed at upper portions in the electronic apparatus, the electronic apparatus including the cooling device 120 according to the first comparative example is upsized in the height direction.

Figure 6:
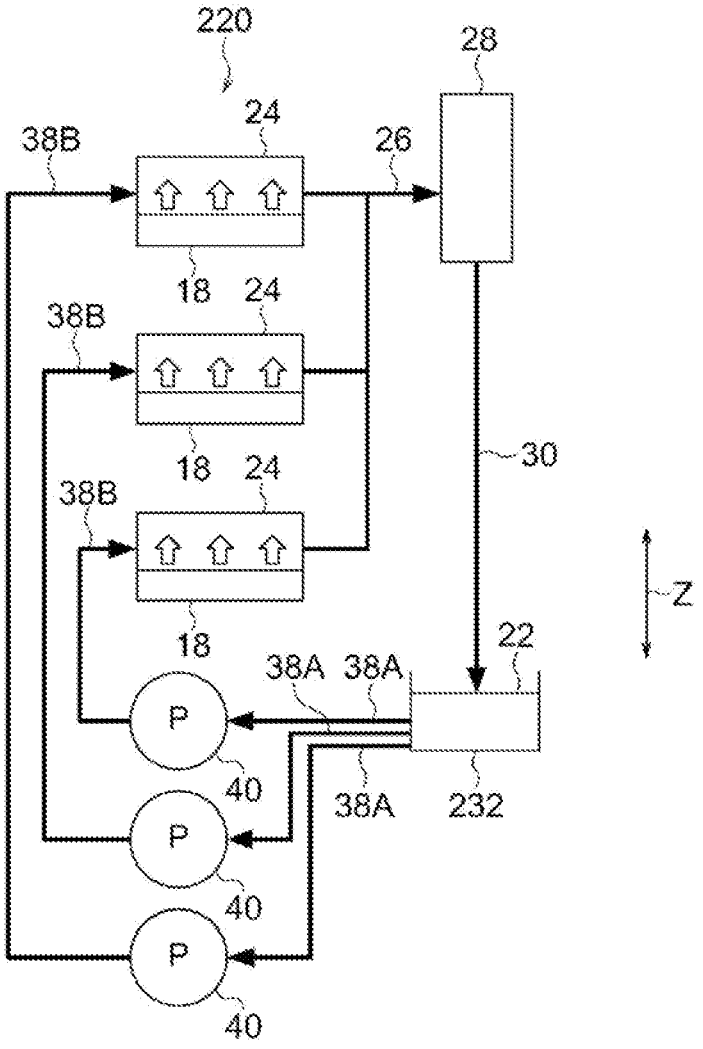
FIG. 6 is a diagram schematically illustrating a cooling device according to a second comparative example.

FIG. 6 is a diagram schematically illustrating a cooling device 220 according to the second comparative example. The cooling device 220 according to the second comparative example is an ebullient cooling device including multiple pumps 40. In the cooling device 220 according to the second comparative example, a tank 232 is used instead of the first tank 32 and the second tank 34 (see FIG. 2).

The multiple pumps 40 are coupled to the tank 232 through multiple first coupling pipes 38A, and multiple evaporators 24 are coupled to the multiple pumps 40 through multiple second coupling pipes 38B. A condenser 28 is coupled to the multiple evaporators 24 through a gas-phase pipe 26, and the condenser 28 and the tank 232 are coupled to each other through a liquid-phase pipe 30. The tank 232 and the condenser 28 are arranged beside the multiple evaporators 24, and the multiple pumps 40 are arranged at positions lower than the multiple evaporators 24.

In the cooling device 220 according to the second comparative example, a refrigerant 22 changed to the liquid phase by condensation in the condenser 28 is sent to the tank 232 through the liquid-phase pipe 30 and stored in the tank 232. The rotation speed of each of the multiple pumps 40 is controlled in accordance with a power consumption or amount of heat generated by the corresponding one of the multiple devices 18, and each of the multiple evaporators 24 is supplied with the refrigerant 22 in an amount equal to the amount of the refrigerant 22 reduced by evaporation. Thus, the multiple devices 18 different in power consumption are continuously and appropriately cooled by the multiple evaporators 24.

In the cooling device 220 according to the second comparative example, the tank 232 and the condenser 28 are disposed beside the multiple evaporators 24, and therefore an electronic apparatus including the cooling device 220 according to the second comparative example may be downsized in the height direction.

However, in the cooling device 220 according to the second comparative example, the pump 40 is requested for each of the multiple evaporators 24, which results in upsizing of the electronic apparatus. In addition, in a case where the multiple pumps 40, which are life-limited components, are disposed at positions where the replacement is easy, the structure of the electronic apparatus 10 is complicated.

In contrast, in the cooling device 20 according to the present embodiment illustrated in FIG. 2, the second tank 34 that stores the refrigerant 22 is disposed at the position higher than the multiple evaporators 24, and the second tank 34 and the first tank 32 are coupled to each other by the bypass pipe 42. As illustrated in FIG. 3, the first joint port 54 of the second tank 34 to be joined to the bypass pipe 42 is formed at the position higher than the second joint ports 56 of the second tank 34 to be joined to the respective distribution pipes 36 and the third joint port 58 of the second tank 34 to be joined to the coupling pipe 38. The inner diameter of the bypass pipe 42 is larger than the inner diameter of each of the distribution pipes 36.

Thus, when the refrigerant 22 is distributed from the second tank 34 to the multiple evaporators 24 through the multiple distribution pipes 36, part of the refrigerant 22 stored in the second tank 34 is returned to the first tank 32 through the bypass pipe 42. Thus, the pressure of the pump 40 is released to the bypass pipe 42 and therefore is inhibited from acting on the multiple distribution pipes 36.

In this state, as similarly to a pump-less ebullient cooling device, the refrigerant 22 flows into each of the multiple evaporators 24 from the second tank 34 due to its own weight in accordance with the amount of heat generated by the corresponding one of the multiple devices 18. For example, each of the multiple evaporators 24 is supplied with the refrigerant 22 in an amount equal to an amount of the refrigerant 22 reduced by evaporation. Thus, the multiple devices 18 different in power consumption may be continuously and appropriately cooled by the multiple evaporators 24.

In the cooling device 20 according to the present embodiment, for example, the second tank 34 is disposed at the upper portion in the electronic apparatus 10, and the condenser 28 is disposed at the position horizontally shifted from the second tank 34. Thus, as compared with the case where the condenser 28 is disposed at the position higher than the tank 132, the electronic apparatus 10 may be downsized in the height direction as in the case of the pump-less cooling device 120 according to the first comparative example (see FIG. 5). This makes it possible to increase the number of electronic apparatuses 10 mountable in a rack in the case where the electronic apparatuses 10 are mounted in the rack.

The cooling device 20 according to the present embodiment requests only one pump 40. Thus, the electronic apparatus 10 may be downsized as compared with the cooling device 220 according to the second comparative example including the multiple pumps 40 (see FIG. 6). Even when the pump 40, which is a life-limited component, is disposed at a position where the replacement is easy, the complication of the structure of the electronic apparatus 10 may be reduced, so that the structure of the electronic apparatus 10 may be simplified. The cooling device 20 may have a so-called redundant configuration using two or more pumps 40.

In the cooling device 20 according to the present embodiment, the first tank 32 and the pump 40 are disposed at the positions lower than the multiple evaporators 24. Thus, the space at a lower portion in the electronic apparatus 10 may be effectively used for disposing the first tank 32 and the pump 40. In addition, the structure in which the first tank 32 and the pump 40, which are heavy components, are disposed at the lower portion in the electronic apparatus 10 also makes it possible to lower the center of gravity of the electronic apparatus 10.

Next, modifications of the present embodiment will be described.

Figure 4:
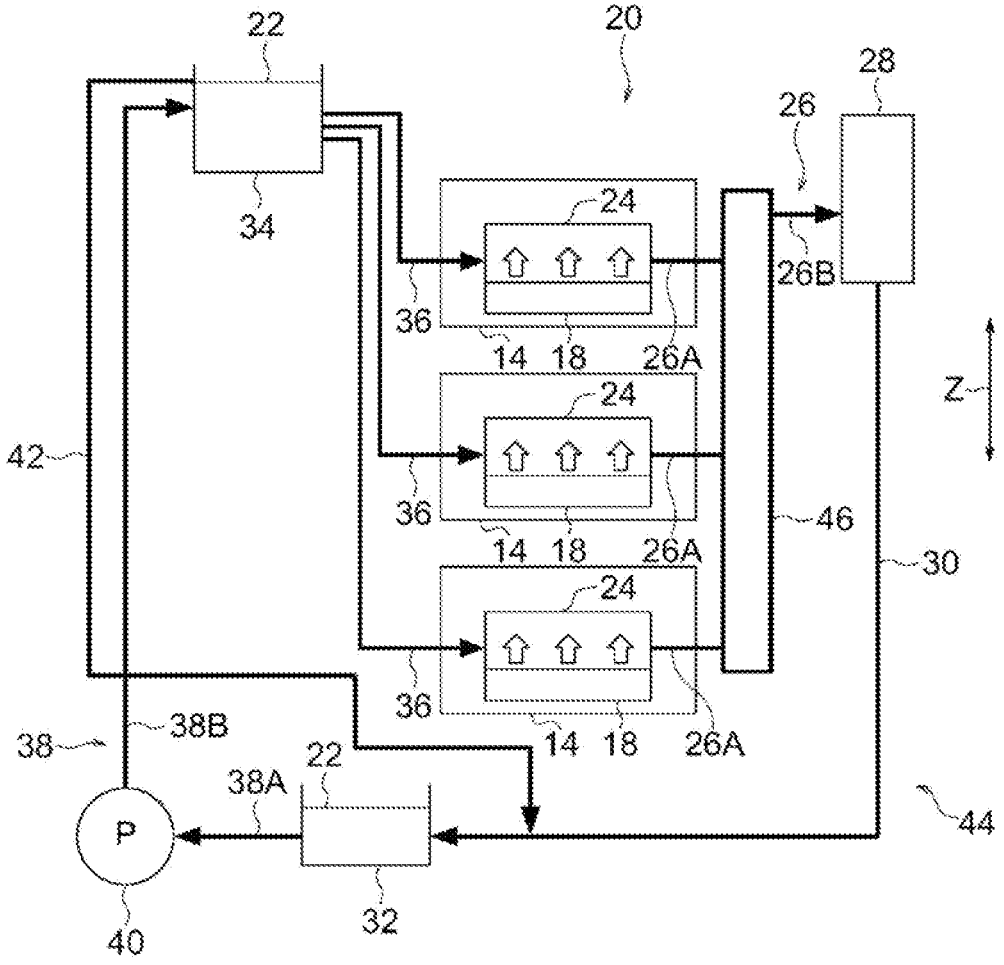
FIG. 4 is a diagram illustrating a modification of the cooling device illustrated in FIG. 2.

In the above-described embodiment, the bypass pipe 42 couples the second tank 34 and the first tank 32. Instead, as illustrated in FIG. 4, the bypass pipe 42 may couple the second tank 34 and the liquid-phase pipe 30. With such a structure, part of the refrigerant 22 stored in the second tank 34 is returned to the first tank 32 through the bypass pipe 42 and the liquid-phase pipe 30. Thus, the same effects as in the above-described embodiment may be obtained.

In the above-described embodiment, the multiple evaporators 24 are coupled to the condenser 28 by the gas-phase pipe 26 including the multiple branch pipes 26A and the trunk pipe 26B. Instead, the multiple evaporators 24 may be coupled to the condenser 28 by multiple gas-phase pipes 26 independent of each other.

In the above-described embodiment, the second joint ports 56 are formed at the positions lower than the third joint port 58. However, as long as the first joint port 54 is formed at the position higher than the second joint ports 56 and the third joint port 58, the second joint ports 56 may be formed at positions as high as or higher than the third joint port 58.

In the above-described embodiment, the cooling device 20 is mounted on the electronic apparatus 10 that is the network apparatus. Alternatively, the cooling device 20 may be mounted on any electronic apparatus other than the network apparatus.

In the above-described embodiment, each of the evaporators 24 is thermally coupled to the device 18, but may be thermally coupled to any heat generating device other than the device 18.

Although the embodiment of the technique disclosed herein has been described, the technology disclosed herein is not limited to the above embodiment. Of course, the technology disclosed herein may be varied and embodied in a variety of manners, in addition to the above embodiment, without departing from the gist thereof.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A cooling device comprising:

a plurality of evaporators thermally coupled to a plurality of heat generating devices, respectively;

a condenser coupled to the plurality of evaporators through a gas-phase pipe;

a first tank coupled to the condenser through a liquid-phase pipe and configured to store a refrigerant therein, the first tank being coupled downstream in a refrigerant flow from the condenser;

a second tank disposed at a position higher than the plurality of evaporators and configured to store the refrigerant therein;

a plurality of distribution pipes each through which a corresponding evaporator of the plurality of evaporators is coupled to the second tank;

a pump coupled to the first tank and the second tank through coupling pipes, respectively; and a bypass pipe through which the second tank is coupled to one of the first tank and the liquid-phase pipe, wherein the second tank includes a first joint port to be joined to the bypass pipe, second joint ports to be joined to the respective distribution pipes, and a third joint port to be joined to one of the coupling pipes, the first joint port being formed at a position higher than the second joint ports and the third joint port, and wherein an inner diameter of the bypass pipe is larger than an inner diameter of each of the distribution pipes.

2. The cooling device according to claim 1, wherein the condenser is disposed at a position horizontally shifted from the second tank.

3. The cooling device according to claim 1, wherein the first tank is disposed at a position lower than the plurality of evaporators.

4. The cooling device according to claim 1, wherein the pump is disposed at a position lower than the plurality of evaporators.

5. The cooling device according to claim 1, wherein the first tank is disposed at a position lower than the second tank.

6. The cooling device according to claim 1, wherein the pump is disposed at a position lower than the second tank.

7. The cooling device according to claim 1, wherein the condenser is disposed at a position higher than the first tank.

8. The cooling device according to claim 1, wherein an upper portion of the first tank or the second tank is partially or entirely opened.

9. The cooling device according to claim 1, wherein an opening area of the first joint port is larger than an opening area of each of the second joint ports.

10. The cooling device according to claim 1, wherein the second tank includes a bottom wall and a peripheral wall formed around the bottom wall, and wherein the first joint port, the second joint ports, and the third joint port are all formed in the peripheral wall.

11. The cooling device according to claim 1, wherein a liquid level of the refrigerant in the second tank is set at a position higher than a lower end of the first joint port.

12. An electronic apparatus comprising:

a plurality of plug-in cards each configured to include a heat generating device; and a cooling device for cooling the heat generating device of the plurality of plug-in cards, wherein the cooling device includes:

a plurality of evaporators thermally coupled to the heat generating device of each of the plurality of plug-in cards, respectively, a condenser coupled to the plurality of evaporators through a gas-phase pipe, a first tank coupled to the condenser through a liquid-phase pipe and configured to store a refrigerant therein, the first tank being coupled downstream in a refrigerant flow from the condenser, a second tank disposed at a position higher than the plurality of evaporators and configured to store the refrigerant therein, a plurality of distribution pipes each through which a corresponding evaporator of the plurality of evaporators is coupled to the second tank, a pump coupled to the first tank and the second tank through coupling pipes, respectively, and a bypass pipe through which the second tank is coupled to one of the first tank and the liquid-phase pipe, wherein the second tank includes a first joint port to be joined to the bypass pipe, second joint ports to be joined to the respective distribution pipes, and a third joint port to be joined to one of the coupling pipes, the first joint port being formed at a position higher than the second joint ports and the third joint port, and wherein an inner diameter of the bypass pipe is larger than an inner diameter of each of the distribution pipes.

13. A cooling method comprising:

evaporating a refrigerant by heat of a plurality of heat generating devices in a plurality of evaporators thermally coupled to the plurality of heat generating devices, respectively;

condensing the refrigerant in a condenser coupled to the plurality of evaporators through a gas-phase pipe;

storing the refrigerant in a first tank coupled to the condenser through a liquid-phase pipe, the first tank receiving the refrigerant condensed by the condenser downstream in a refrigerant flow from the condenser;

sending, by a pump, the refrigerant stored in the first tank to a second tank disposed at a position higher than the plurality of evaporators so as to store the refrigerant in the second tank; and distributing the refrigerant from the second tank to the plurality of evaporators through a plurality of distribution pipes, respectively, wherein when the refrigerant is distributed from the second tank to the plurality of evaporators through the plurality of distribution pipes, part of the refrigerant stored in the second tank is returned to the first tank through a bypass pipe, so that a pressure of the pump is released to the bypass pipe and is inhibited from acting on the plurality of distribution pipes and the refrigerant flows from the second tank into each of the plurality of evaporators due to an own weight of the refrigerant in accordance with an amount of heat generated by the plurality of heat generating devices.

* * * * *